United States Patent [19]

Klein et al.

[11] Patent Number: 4,952,179

[45] Date of Patent: Aug. 28, 1990

[54] SALT MUSHROOM CUTTING APPARATUS

[75] Inventors: Shlomo Klein, Herzlia; Adi Zucker, Zahala, both of Israel

[73] Assignees: Contract Line Ltd.; Edoni Ltd., both of Tel-Aviv, Israel

[21] Appl. No.: 341,871

[22] Filed: Apr. 24, 1989

[30] Foreign Application Priority Data

May 24, 1988 [IL] Israel ..... 86481

[51] Int. Cl.[5] ..... B63H 19/08; E02F 3/88

[52] U.S. Cl. ..... 440/36; 37/66; 37/73; 299/87

[58] Field of Search ..... 440/36; 37/64, 66, 73; 299/87, 9

[56] References Cited

U.S. PATENT DOCUMENTS

| | | | |
|---|---|---|---|
| 415,501 | 11/1889 | Cole | 440/36 |
| 939,878 | 11/1909 | Urie | 37/73 X |
| 997,247 | 7/1911 | Ferris et al. | 37/73 |
| 2,260,293 | 5/1940 | Brown | 37/73 |
| 2,665,655 | 1/1954 | Brown et al. | 37/66 |
| 3,003,454 | 10/1961 | Shatoska et al. | 440/36 |
| 3,512,280 | 10/1967 | Perna | 37/66 |
| 3,516,712 | 6/1970 | Bennett et al. | 299/87 |
| 3,521,387 | 7/1970 | Degelman | 37/66 |
| 3,656,449 | 4/1972 | Mead | 37/73 |
| 3,902,448 | 9/1975 | Davis | 37/73 |
| 3,919,790 | 11/1975 | Sasaki et al. | 37/66 |
| 3,962,803 | 6/1976 | O'Brien | 37/66 |
| 4,037,874 | 7/1977 | Willums | 37/66 |
| 4,399,623 | 8/1983 | Neumann | 37/73 |
| 4,702,024 | 10/1987 | Shiba et al. | 37/67 |

FOREIGN PATENT DOCUMENTS

| | | | |
|---|---|---|---|
| 1458259 | 11/1966 | France | 37/73 |
| 800299 | 1/1981 | U.S.S.R. | 37/73 |

*Primary Examiner*—Sherman Basinger

*Attorney, Agent, or Firm*—Benjamin J. Barish

[57] ABSTRACT

Salt mushroom cutting apparatus for removing salt mushrooms from a water body, comprises a vessel floatable on the water body, and a helical cutter carried by the vessel forwardly of its bow and extending transversely thereof for pulverizing the salt bodies as the vessel is propelled forwardly through the water body. The helical cutter is wider than the vessel and includes a drum rotated about its longitudinal axis, and a helical array of cutter tips projecting from the outer surface of the drum. The propelling means includes at least one pair of spuds on the opposite sides of the vessel, a vertical drive for lowering the spuds into the water bed, and a horizontal drive for driving the vessel forwardly with respect to the spuds when anchored in the water bed.

19 Claims, 4 Drawing Sheets

FIG 3
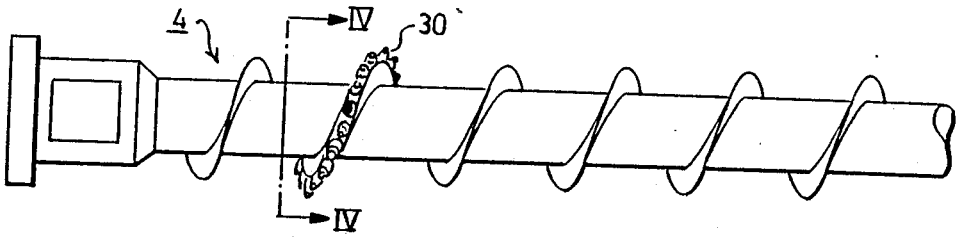
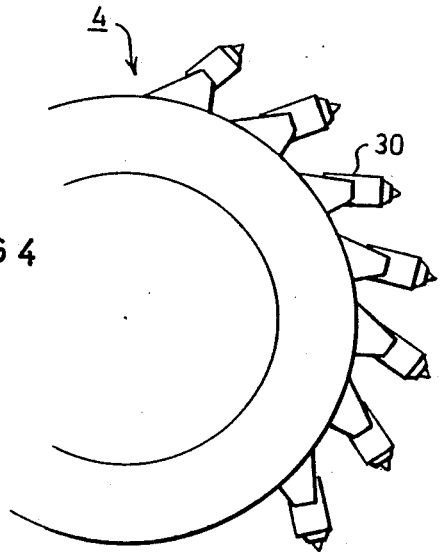
FIG 4

FIG 5
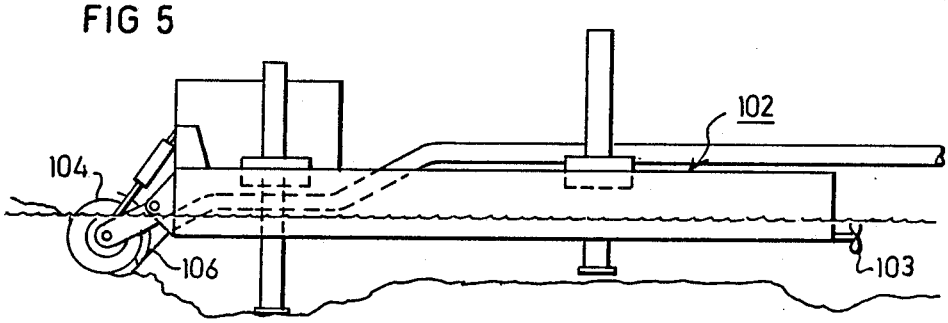
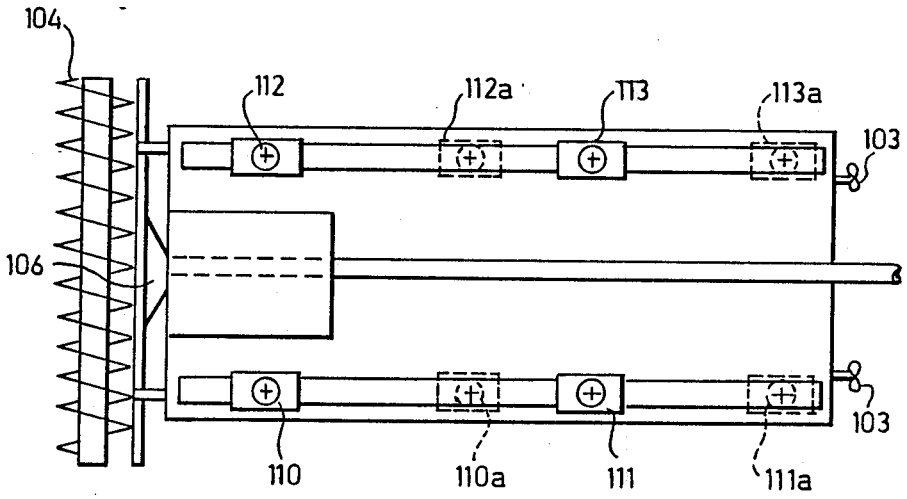
FIG 6

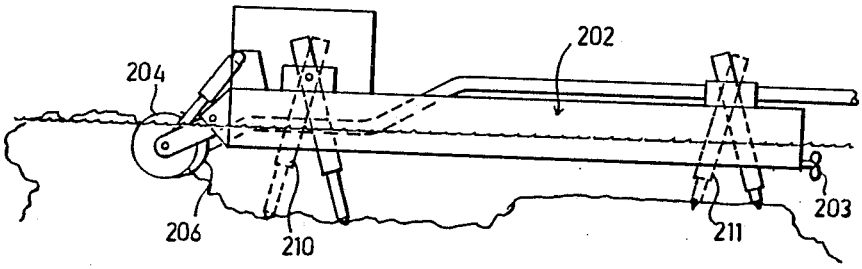
FIG. 7
FIG. 8
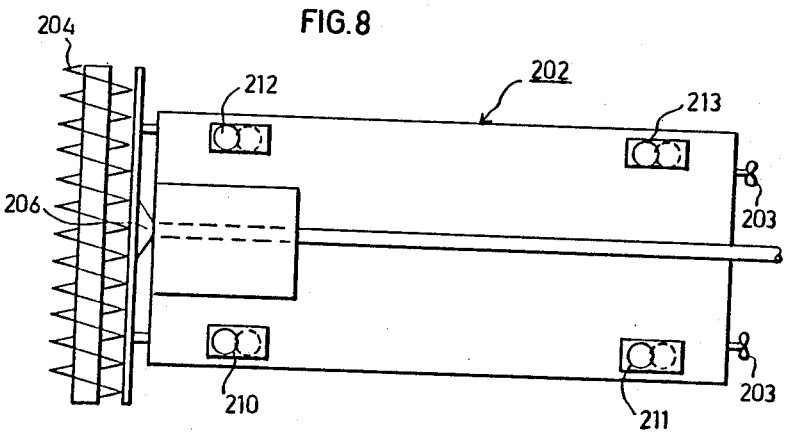

SALT MUSHROOM CUTTING APPARATUS

BACKGROUND OF THE INVENTION

The present invention relates to apparatus for removing large deposits of minerals or salt, called "salt mushrooms", formed in water bodies having high concentration of salts, such as in the Dead Sea; and the invention is therefore described below with respect to this application.

The Dead Sea is a very important source of potash, bromine and other chemicals, which are removed by forming solar evaporation ponds in order to increase their concentration by solar evaporation of water. However, the salts precipitate out in the form of large solid bodies, called "salt mushrooms". These generally have relatively large bases fixed to the water bed, more slender trunks rising to the water line, and then very large, mushrooming heads which can rise above the water line. These solid bodies reduce the rate of water flow, and their large mushrooming heads shade the water from the solar radiation, thereby decreasing the rate of evaporation of the water produced by the solar radiation.

Various techniques have been proposed for removing these salt mushrooms. However, conventional dredging operations which are generally efficient when removing mud and other relatively soft materials, are not efficient, and usually not even effective, when clearing away these salt mushrooms. Thus, in the zones of the water body not occupied by a salt mushroom, the power requirements for the dredging apparatus are very low, but when the dredging apparatus engages one of these salt mushrooms, an extremely high load is imposed on the apparatus.

OBJECTS AND SUMMARY OF THE INVENTION

An object of the present invention is to provide novel apparatus especially useful for removing large salt bodies, such as the above-mentioned "salt mushrooms", from evaporation-pond type water bodies, such as the Dead Sea.

According to the present invention, there is provided salt mushroom cutting apparatus for removing salt mushrooms from a water body, comprising a vessel floatable on the water body; propelling means for propelling the vessel forwardly through the water body; and a helical cutter carried by the vessel forwardly of its bow and extending transversely thereof for pulverizing the salt bodies as the vessel is propelled forwardly through the water body. The helical cutter is wider than the vessel and includes a drum rotated about its longitudinal axis, and a helical array of cutter tips projecting from the outer surface of the drum. A helical cutter such as used in hard mining or land, e.g., coal mining, may be used for this purpose.

According to another important feature in the preferred embodiment of the invention described below, the propelling means includes at least one pair of spuds on the opposite sides of the vessel; a vertical drive for lowering the spuds into the water bed to anchor the spuds therein, and for raising the spuds to release it from the water bed; and a horizontal drive for driving the vessel forwardly with respect to the spuds when anchored in the water bed.

In the described preferred embodiment, the dredging apparatus further includes suction means for drawing in the pulverized solids and for conveying them to a disposal location. The pulverized solids may be dispersed in their pulverized form over the water body, or may be conveyed to another barge or to a shore location for disposal or for processing to extract various chemicals therefrom.

According to further important features in the described preferred embodiment, the helical cutter includes two axially-aligned cutter sections. The helix of each section is oriented to feed the pulverized solids to a collection zone at the juncture of the two sections, the suction head being located at the juncture.

In one described embodiment, there is one pair of spuds movable the complete length of the vessel. Another embodiment is described wherein there are two pairs of spuds, one pair mounted on opposite sides of the vessel bow to reach an intermediate point of the vessel, the other pair mounted on opposite sides of the vessel at points slightly aft of the intermediate point to reach the stern of the vessel. A further embodiment is described wherein the propelling means includes two pairs of "walking spuds".

Apparatus constructed in accordance with the foregoing features may be efficiently used for clearing away the above-described "salt mushrooms" formed in evaporation ponds such as the Dead Sea, or for other removing operations involving very high but fluctuating power requirements. The invention thus overcomes hard material sea mining by combining land-mining and marine practise.

Further features and advantages of the invention will be apparent from the description below.

BRIEF DESCRIPTION OF THE DRAWINGS

The invention is herein described, by way of example only, with reference to the accompanying drawings, wherein:

FIG. 3 is an enlarged fragmentary view illustrating the helical cutter used in the apparatus of FIGS. 1–3;

FIG. 4 is an enlarged, fragmentary transverse sectional view of the helical cutter along line IV—IV of FIG. 3;

FIGS. 5 and 6 illustrate another embodiment of the invention including two pairs of spuds for propelling the vessel; and FIGS. 7 and 8 illustrates a further embodiment including two pairs of "walking spuds" mounted on opposite sides of the vessel for propelling the vessel.

DESCRIPTION OF PREFERRED EMBODIMENTS

Figure 1:
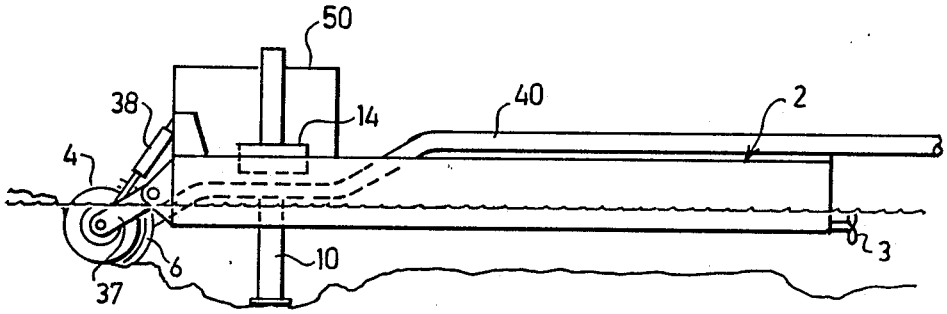
FIG. 1 is a side elevational view illustrating one form of salt mushroom cutting apparatus constructed in accordance with the present invention.
Figure 2:
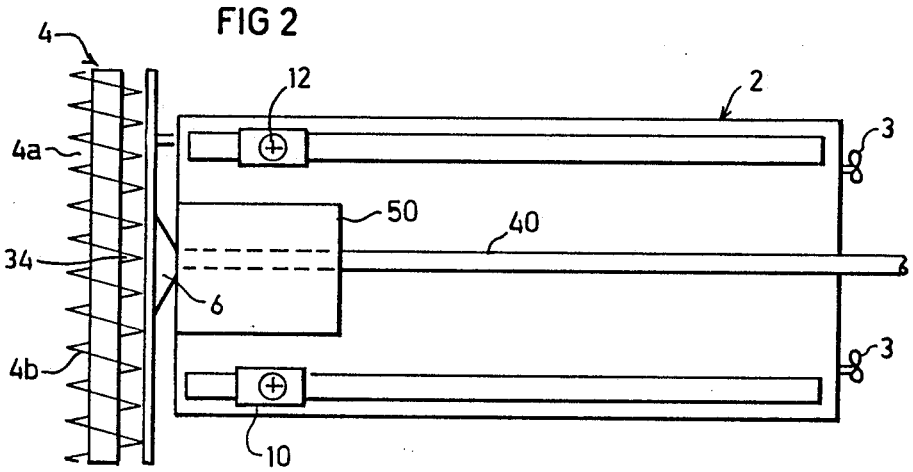
FIG. 2 is top plan view of the apparatus of FIG. 1.

The apparatus illustrated in FIGS. 1–4 of the drawings is particularly useful for removing solid bodies from a water body where the load requirements are very high and/or fluctuating, such as for clearing away the above-described "salt mushrooms" formed in the solar evaporation ponds of the "Dead Sea". The apparatus includes a vessel or barge 2 floatable on the water body, propelling means including two conventional propellers 3 for propelling the vessel forwardly through the water body, and a helical cutter 4 carried by the vessel forwardly of its bow and extending transversely of the vessel, for pulverizing the solid bodies as the vessel is propelled forwardly through the water body. The apparatus further includes a suction head 6 for drawing in the pulverized solids and for disposing them as desired.

In the embodiment of the invention illustrated in FIGS. 1–4, the propelling means includes, in addition to the conventional propellers 3, a pair of spuds 10, 12 on opposite sides of the head of the vessel bow. These spuds are lowered into the water bed to anchor the spuds therein, and the vessel is then driven forwardly to bring the stern of the vessel to the spuds. The spuds are then raised and returned to the bow of the vessel for repeating the propelling cycle.

Each of the two spuds 10, 12 includes a drive, schematically shown at 14, for raising and lowering the spud and for effecting relative movement longitudinally from the bow to the stern of the vessel.

The helical cutter 4, carried by vessel 2 forwardly of its bow and extending transversely of the vessel, may be of the type commonly used in land-mining operations, such as for mining coal. It is in the form of a drum rotatable about its longitudinal axis, and includes a helical array of cutter tips 30 projecting from its outer face, as shown particularly in FIGS. 3 and 4. The cutter tips 30 are generally made of tungsten carbide and may be individually driven about their own respective axes or fixed on their axes.

The cutter includes at least two axially-aligned cutter sections of oppositely-directed helices so as to feed the pulverized material towards the juncture of the two helices. Thus, as shown particularly in FIG. 2, cutter 4 includes a section **4*a* having a right-hand helix joined to a section 4*b* having a left-hand helix, such that the rotation of the helical cutter tends to move the pulverized material towards the juncture 34**.

Juncture 34 thus serves as a collection region for the pulverized material. Suction head 6 is of a funnel configuration and is disposed adjacent to this collection region 34 so as to draw in the pulverized material accumulating in this region.

As shown particularly in FIG. 1, the helical cutter 4 is supported by a pivotal mounting 37 forwardly of the vehicle bow, which pivotal mounting enables the helical cutter to be raised or lowered with respect to the water bed. A hydraulic piston 38 pivots the cutter head 4 to any desired vertical position. The hoisting and lowering of the cutter head 4 may be effected by a pair of hydraulic pistons movable in cylinders. The cutter head should be mounted so as to cut protruding salt mushrooms up to about one meter above pond water level, and two meters below the pond water level. The cutter head 4 is wider than the vessel, and thereby enables the vessel to advance straight ahead while cutting without the need for side maneuvering.

Suction head 6 is mounted to the same pivotal mounting 37 as the helical cutter 4. Since this suction head is located at the juncture between the two differently-oriented helical sections **4*a*, 4*b*** and is of a funnel configuration, it draws in the pulverized substances fed to this collection region by the helical cutter.

Suction head 6 is connected by a conduit 40 to the vessel bow. Conduit 40 may in turn be coupled to a distributor conduit (not shown) for dispersing the pulverized substances over the water body. Alternatively, conduit 40 may be connected to a pipe (not shown) floating on the water body in order to convey the pulverized substances to another barge, or to a shore location, for disposal or for extracting salts therefrom.

The drives for the helical cutter 4, the suction head 6, and the spuds 10, 12, are all mounted on the vessel. These drives are schematically shown at 50 in FIGS. 1 and 2.

The operation of the salt mushroom cutting apparatus illustrated in FIGS. 1–4 will be apparent from the above description. Normally, the vessel is propelled forwardly by the propellers 3 to the area of the "salt mushrooms", and in this area, the spuds 10, 12 are used for propelling the vessel. This is done by first moving the two spuds 10, 12 to the vessel bow via their drives 14 and then lowering them into the water bed. Drive 14 is then operated to effect relative movement between the so-anchored spuds and the vessel, thereby causing the vessel to be propelled forwardly while the spuds move to the stern of the vessel. At that time the spuds are again raised, moved to the head of the vessel, and then lowered into the water bed to produce another propulsion cycle.

As the vessel is thus propelled forwardly by the above-described spuds, the helical cutter 4 is rotated so as to pulverize the salt mushroom. The right-hand helical section **4*a* and the left-hand helical section 4*b* of the cutter 4 feed the pulverized materials to the collection region 34 at the juncture between the two sections, where the pulverized material is drawn into the suction head 6 by the suction created therein. The pulverized material is then conveyed via conduit 40** to the stern of the vessel, where it may be dispersed over the water body by an oscillating distributor conduit or conveyed to another barge or to a location on the shore by a floating pipe connected to fitting.

During the pulverizing operation, the helical cutter 6 may be moved vertically in order to completely pulverize the engaged salt mushroom, including its base, trunk and its head.

Maneuvering the vessel may be achieved by lowering only one spud and directing a thrust, either by jets or by a conventional screw, to propel the vessel in the desired direction.

FIGS. 5 and 6 illustrate another embodiment of the invention, also including a vessel, therein designated 102, a propeller drive 103, a helical cutter 104, and a suction head 106 as described above, but a slightly different propulsion means for propelling the vessel forwardly under high loads.

Thus, the propulsion means illustrated in FIGS. 5 and 6 includes two pairs of spuds 110, 112 and 111, 113. One pair of spuds 110, 112 are mounted on opposite sides of the vessel bow and are movable horizontally to an intermediate point, e.g., the midline, as shown by the broken-line positions **110*a*, 112*a* (FIG. 6) of the two spuds; whereas the other pair of spuds 111, 113 are mounted on opposite sides of the vessel at points slightly aft of the intermediate point, and are movable to the vessel stern, as shown by the broken-line positions 111*a*, 113*a* (FIG. 6**) of the spuds.

When the first pair of spuds 110, 112 are anchored in the water bed while propelling the vessel forwardly, the other pair of spuds 111, 113 would be clear of the water bed to permit the vessel to move forwardly; and when spuds 110, 112 are clear of the water bed during their return to their initial positions, spuds 111, 113 would be anchored in the water bed to propel the vessel forwardly. This arrangement allows better control of the vessel at all times since one pair of spuds are always anchored in the water bed. It also permits more efficient propulsion of the vessel by reducing the "pauses" between strokes, and enables a greater propulsion force to be applied to the vessel by using both pairs of spuds together.

It will thus be seen that when two pairs of moving spuds are used, the spuds can move together, or independently, upwardly, downwardly, or alongside the vessel. This enables the spuds to function as stabilizers while cutting, as an advancing drive to push the vessel against the mushrooms while cutting, and also as a lifting and lowering device for lifting and lowering the vessel to assist its movement in case of underwater rough terrain.

FIGS. 7 and 8 illustrate a further embodiment of the invention, also including a vessel 202, a propeller drive 203, a helical cutter 204, and a suction head 206, as described above with respect to FIGS. 1–6, but another form of propulsion means for propelling the vessel forwardly under high loads. Thus, the propelling means in the embodiment of FIG. 8 includes two pairs of "walking spuds" 210, 212, and 211, 213, respectively. One pair of spuds 210, 212 are mounted on opposite sides of the bow portion of the vessel 202 and are movable through an arc to engage the bottom of the water bed and thereby to propel the vessel forwardly; and a second pair of spuds 211, 213 are mounted on opposite sides of the stern portion of the vessel and are also movable through an arc to engage the bottom of the water bed and thereby also to propel the vessel forwardly. The two pairs of spuds are thus analgous to the arrangement illustrated in FIGS. 6 and 7 and would be operated in substantially the same manner.

While the invention has been described with respect to several preferred embodiments, it will be appreciated that still other variations may be made. For example, the propelling means could include towing cables in addition to, or in lieu of the spuds. Many other variations, modifications and applications of the invention will be apparent.

What is claimed is:

1. Salt mushroom cutting apparatus for removing salt mushrooms from a water body, comprising: a vessel floatable on the water body; propelling means for propelling the vessel forwardly through the water body; and a helical cutter carried by the vessel forwardly of its bow and extending transversely thereof for pulverizing the salt bodies as the vessel is propelled forwardly through the water body; said helical cutter being wider than said vessel and including a drum rotated about its longitudinal axis, and a helical array of cutter tips projecting from the outer surface of the drum.

2. The apparatus according to claim 1, wherein said propelling means includes at least one pair of spuds on the opposite sides of the vessel; a vertical drive for lowering said spuds into the water bed to anchor the spuds therein, and for raising the spuds to release it from the water bed; and a horizontal drive for driving said vessel forwardly with respect to the spuds when anchored in the water bed.

3. Apparatus according to claim 1, further including suction means for drawing in pulverized solids and for conveying them to a disposal location.

4. Apparatus according to claim 3, wherein said helical cutter includes at least two axially-aligned cutter sections oriented to feed the pulverized solids to a collection zone at the juncture of the two cutter sections.

5. Apparatus according to claim 1, wherein said propelling means includes two pairs of spuds, one pair of spuds being mounted on opposite sides of the vessel bow to reach an intermediate point of the vessel at the end of the forward movement of the vessel, the other pair of spuds being mounted on opposite sides of the vessel at points slightly aft of said intermediate point to reach the stern of the vessel at the end of its forward movement.

6. Apparatus according to claim 1, wherein said propelling means comprises at least one pair of spuds mounted on opposite sides of the vessel and movable through an arc to engage the water bed and thereby to propel the vessel forwardly.

7. Apparatus according to claim 6, wherein said propelling means comprises a first pair of spuds mounted on opposite sides of the bow portion of the vessel, and a second pair of spuds mounted on opposite sides of the stern portion of the vessel, both pairs of spuds being movable through an arc to engage the water bed and thereby to propel the vessel forwardly.

8. Apparatus according to claim 1, wherein said helical cutter includes a vertical drive for raising and lowering the helical cutter with respect to the water bed sufficiently to cut salt mushrooms up to about one meter above the water level and two meters below the water level.

9. Apparatus according to claim 1, wherein said helical cutter feeds pulverized solids to a collection zone of the helical cutter, and includes a suction head located at said collection zone for drawing in the pulverized solids, and conduit means for conveying the pulverized solids to a disposal location.

10. Salt mushroom cutting apparatus for removing salt mushrooms from a water body, comprising: a vessel floatable on the water body; propelling means for propelling the vessel forwardly through the water body; and a helical cutter carried by the vessel forwardly of its bow and extending transversely thereof for pulverizing the salt bodies as the vessel is propelled forwardly through the water body; said helical cutter being wider than said vessel and including a helical array of cutter tips projecting from its outer surface and a vertical drive for raising and lowering the helical cutter with respect to the water bed sufficiently to cut salt mushrooms up to about one meter above the water level and two meters below the water level.

11. Apparatus according to claim 10, further including suction means for drawing in pulverized solids and for conveying them to a disposal location.

12. Apparatus according to claim 11, wherein said helical cutter feeds pulverized solids to a collection zone of the helical cutter, and includes a suction head located at said collection zone for drawing in the pulverized solids, and conduit means for conveying the pulverized solids to a disposal location.

13. Apparatus according to claim 12, wherein said helical cutter includes at least two axially-aligned cutter sections oriented to feed the pulverized solids to said collection zone which is at the juncture of the two cutter sections.

14. The apparatus according to claim 10, wherein said propelling means includes at least one pair of spuds on the opposite sides of the vessel; a vertical drive for lowering said spuds into the water bed to anchor the spuds therein, and for raising the spuds to release it from the water bed; and a horizontal drive for driving said vessel forwardly with respect to the spuds when anchored in the water bed.

15. Apparatus according to claim 10, wherein said propelling means includes two pairs of spuds, one pair of spuds being mounted on opposite sides of the vessel bow to reach an intermediate point of the vessel at the end of the forward movement of the vessel, the other pair of spuds being mounted on opposite sides of the vessel at points slightly aft of said intermediate point to reach the stern of the vessel at the end of its forward movement.

16. Apparatus according to claim 10, wherein said propelling means comprises at least one pair of spuds mounted on opposite sides of the vessel and movable through an arc to engage the water bed and thereby to propel the vessel forwardly.

17. Apparatus according to claim 16, wherein said propelling means comprises a first pair of spuds mounted on opposite sides of the bow portion of the vessel, and a second pair of spuds mounted on opposite sides of the stern portion of the vessel, both pairs of spuds being movable through an arc to engage the water bed and thereby to propel the vessel forwardly.

18. Salt mushroom cutting apparatus for removing salt mushrooms from a water body, comprising: a vessel floatable on the water body; propelling means for propelling the vessel forwardly through the water body; and a helical cutter carried by the vessel forwardly of its bow and extending transversely thereof for pulverizing the salt bodies as the vessel is propelled forwardly through the water body; said helical cutter being wider than said vessel and including a helical array of cutter tips projecting from its outer surface, and a vertical drive for raising and lowering the helical cutter with respect to the water bed sufficiently to cut salt mushrooms up to about one meter above the water level and two meters below the water level; said propelling means including at least two pairs of spuds on the opposite sides of the vessel; a vertical drive for lowering said spuds into the water bed to anchor the spuds therein, and for raising the spuds to release it from the water bed; and a horizontal drive for driving said vessel forwardly with respect to the spuds when anchored in the water bed.

19. Apparatus according the claim 18, further including suction means for drawing in pulverized solids and for conveying them to a disposal location.

* * * * *